US005599199A

United States Patent [19]

Wright

[11] Patent Number: 5,599,199

[45] Date of Patent: Feb. 4, 1997

[54] POSITIVE LATCH CONNECTOR

[75] Inventor: John O. Wright, York, Pa.

[73] Assignee: Osram Sylvania Inc., Danvers, Mass.

[21] Appl. No.: 438,859

[22] Filed: May 10, 1995

[51] Int. Cl.[6] ..... H01R 13/627

[52] U.S. Cl. ..... 439/357; 439/353

[58] Field of Search ..... 439/359, 350, 439/351, 355, 357, 358, 345, 347

[56] References Cited

U.S. PATENT DOCUMENTS 4,211,461 7/1980 Wescott ..... 439/357

5,131,862 7/1992 Gershfeld ..... 439/357

5,376,016 12/1994 Inaba et al. ..... 439/357

*Primary Examiner*—Hien Vu

*Attorney, Agent, or Firm*—William H. McNeill

[57] ABSTRACT

A positive latch connector is provided which includes a first component which includes at least one resilient arm having a pin extending therefrom at a distal end thereof. A mating second component is provided which includes oppositely inclined adjacent first and second ramps which abut a latch groove. In use, the pin is moved along the first ramp until the pin snaps into the latch groove to lock the first and second components in place. To release the components from each other, the components are rotated relative to each other, and the pin is then moved in an opposite direction along the second ramp until the components are separated.

20 Claims, 3 Drawing Sheets

POSITIVE LATCH CONNECTOR

BACKGROUND OF THE INVENTION

1. Field of the Invention

The present invention relates to a positive latch connector. More particularly, the present invention relates to a positive latch connector for use with electrical connectors such as those used, for example, with an antenna connector.

2. Description of the Prior Art

Typical electrical connectors such as, for example, those used with an antenna connector for an antenna cable such as that used in the automobile industry for radios includes a male connector body generally in the form of a plug and a female connector body generally in the form of a ferrule which forms a socket. In use, the male connector body is plugged into the female connector body to effect a mechanical and electrical connection between the two. Typically, an antenna cable in the form of a coaxial cable is electrically and mechanically attached to one of the connectors such as the male connector, and the other connector, such as the female connector, is electrically and mechanically attached to a circuit such as a circuit on a printed circuit board. In such electrical connectors there is a tendency for the male and female components to become unintentionally disconnected due to opposing axially directed forces which are sometimes inadvertently exerted upon the male connector relative to the female connector. In addition, the lack of satisfactory tactile feedback makes it difficult to know when a suitable connection has been made.

DISCLOSURE OF THE INVENTION

It is an object of the present invention to provide a positive latch connector which prevents inadvertent disconnection thereof.

It is another object of the present invention to provide an electrical connector wherein a first connector body and a second connector body do not become unintentionally disconnected.

It is yet another object of the present invention to provide a positive latch connector which provides tactile feedback during assembly.

A further object of the present invention is to provide an antenna connector wherein a male connector body thereof and a female connector body thereof do not become unintentionally disconnected.

This invention achieves these and other results, in one aspect of the invention, by providing a positive latch connector which comprises a first connector body extending in the direction of a first longitudinal axis. The first connector body comprises at least one first connector which comprises a latch groove, a first ramp and a second ramp. The latch groove extends into an outer surface of the first connector body and is spaced from an end of the first connector body in the direction of the first longitudinal axis. The first ramp is inclined away from the first longitudinal axis from the end of the first connector body to the latch groove. The second ramp is adjacent to the first ramp and in inclined away from the first longitudinal axis from the latch groove to the end. A second connector body is also provided. The second connector body extends in the direction of a second longitudinal axis and comprises at least one second connector. Each second connector comprises a beam which comprises a pin which engages the first ramp in a connecting mode, engages the first latch groove in a connected mode and engages the second ramp in a disconnecting mode.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
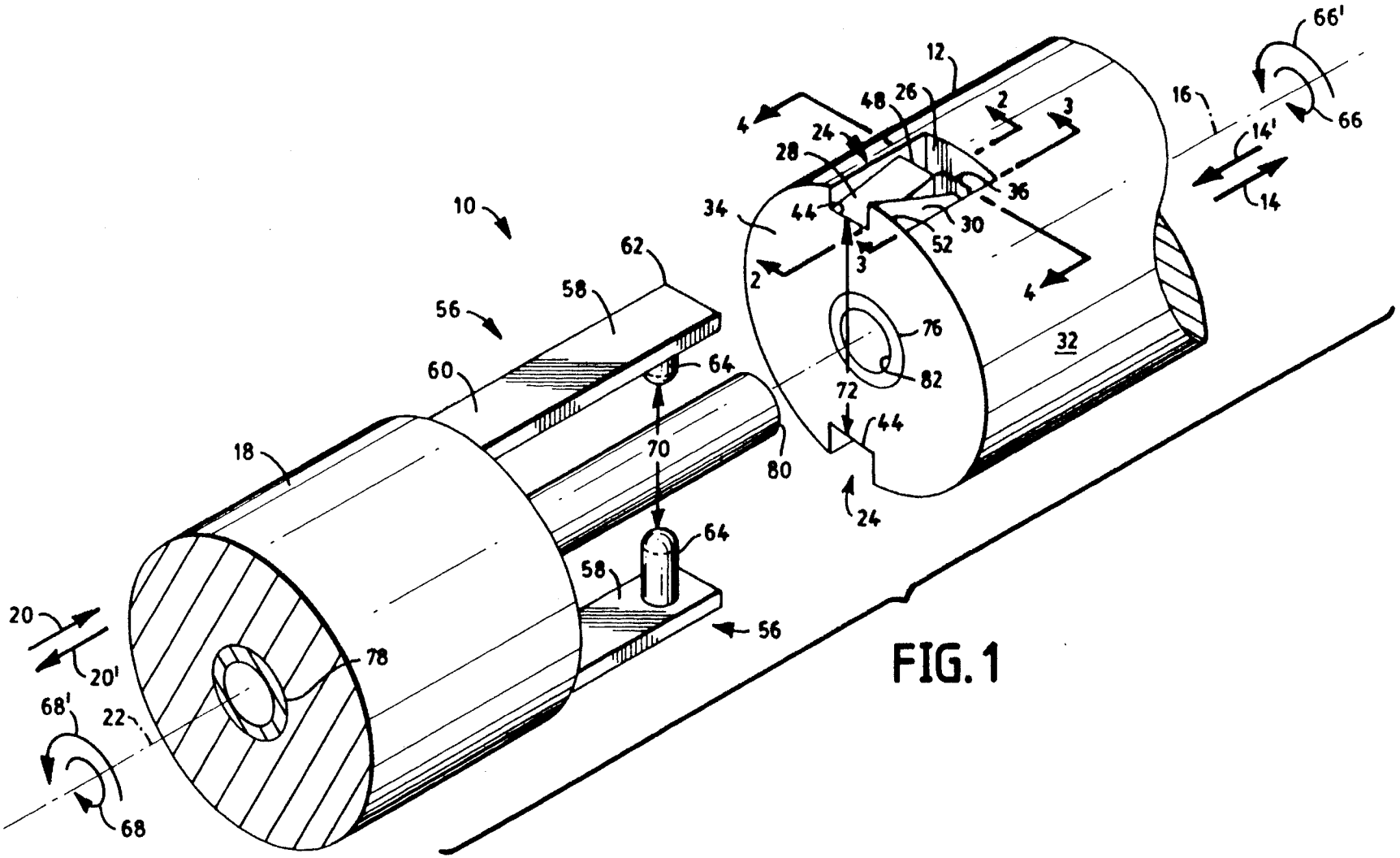
FIG. 1 is an exploded perspective view of one embodiment of the present invention.

The embodiment of this invention which is illustrated in FIGS. 1 to 4 is particularly suited for achieving the objects of this invention. FIG. 1 depicts a positive latch connector 10 which includes a first connector body 12 which extends in the direction 14, 14' of a longitudinal axis 16 of the first connector body, and a second connector body 18 which extends in the direction 20, 20' of a longitudinal axis 22 of the second connector body. When the first connector body 12 is connected to the second connector body 18, axes 16 and 22 will be coincident as depicted in FIG. 1. In the embodiment depicted in the drawings the first connector body 12 and the second connector body 18 are each cylindrical.

The first connector body comprises at least one connector. In the embodiment of FIG. 1 the first connector body 12 includes two connectors 24, although more or less connectors 24 may be provided. Each connector 24 includes a latch groove 26, a first ramp 28 and a second ramp 30 adjacent to first ramp 28.

Figure 4:
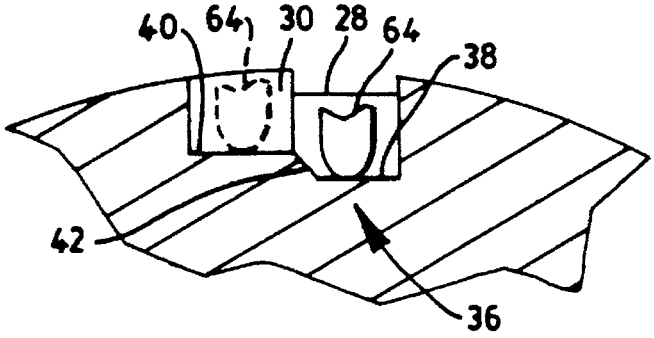
FIG. 4 is a cross-section of FIG. 1 along lines 4—4.

Each latch groove 26 extends into an outer surface 32 of the first connector body 12 and is spaced from an end 34 of the first connector body in the direction 14 of axis 16. Latch groove 26 includes a base segment 36 which is disposed below outer peripheral surface 32. As best seen in FIG. 4, base segment 36 comprises a first base surface 38 adjacent ramp 28 and a second base surface 40 adjacent ramp 30. In the preferred embodiment, the first base surface 38 is connected to the second surface 40 by a third base surface 42 of base segment 36. Base surface 42 provides a ramp which is inclined upwards from base surface 38 to base surface 40. As depicted in FIG. 4, base surface 42 is inclined away from axis 16 from base surface 38 to base surface 40 to provide the upwardly inclined surface 42.

Figure 2:
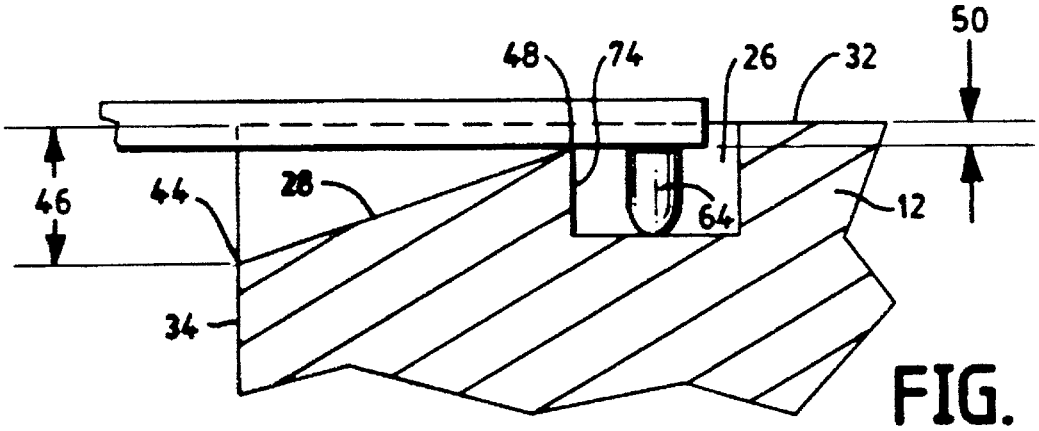
FIG. 2 is a cross-section of FIG. 1 along lines 2—2.
Figure 3:
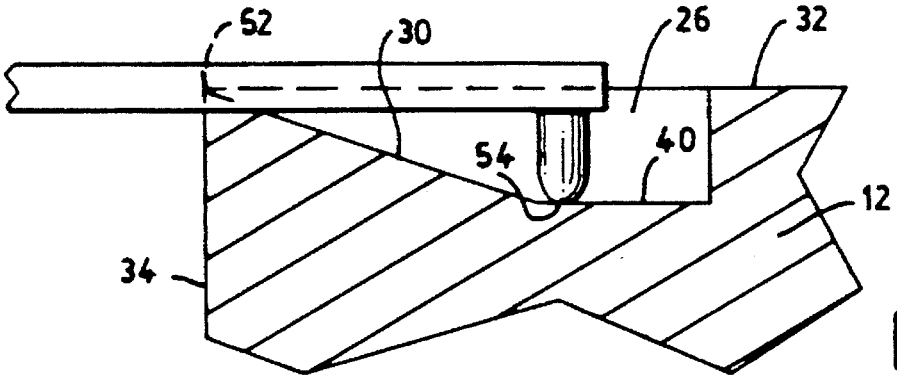
FIG. 3 is a cross-section of FIG. 1 along lines 3—3.

The first ramp 28 is inclined upwards from end 34 and the second ramp 30 is inclined downwards from end 34 as depicted in FIGS. 2 and 3, respectively. In particular, ramp 28 is inclined away from axis 16 from end 34 to the latch groove 26. Ramp 30 is inclined away from axis 16 from latch groove 26 to end 34. Ramp 28 includes a first edge 44 adjacent end 34. Edge 44 is disposed below the outer peripheral surface 32 of the first connector body 12 a distance 46. Ramp 28 includes an opposite second edge 48 adjacent the latch groove 26. Edge 48 is disposed below the outer peripheral surface 32 a distance 50. As depicted in FIG. 2, the distance 50 is less than the distance 46. Ramp 30 includes an edge 52 adjacent end 34 and an opposite edge 54 adjacent ramp 26. As depicted in FIG. 3, edge 52 is coincident with outer surface 32 and edge 54 is coincident with the base surface 40 of base segment 36 of the latch groove 26.

The second connector body comprises at least one connector. In the embodiment of FIG. 1, the second connector body 18 includes two connectors 56 although more or less connectors 56 may be provided. Each connector 56 includes a beam 58. In the embodiment of FIG. 1, beam 58 is in the form of a flexible segment which extends in the direction of axis 22 from a proximate end 60 to a distal end 62. A pin 64 protrudes from the distal end 62 towards axis 22. Pin 64 engages a ramp 28 in a connecting mode, engages a latch groove 26 in a connected mode and engages a ramp 30 in a disconnecting mode, as described herein.

Figure 5:
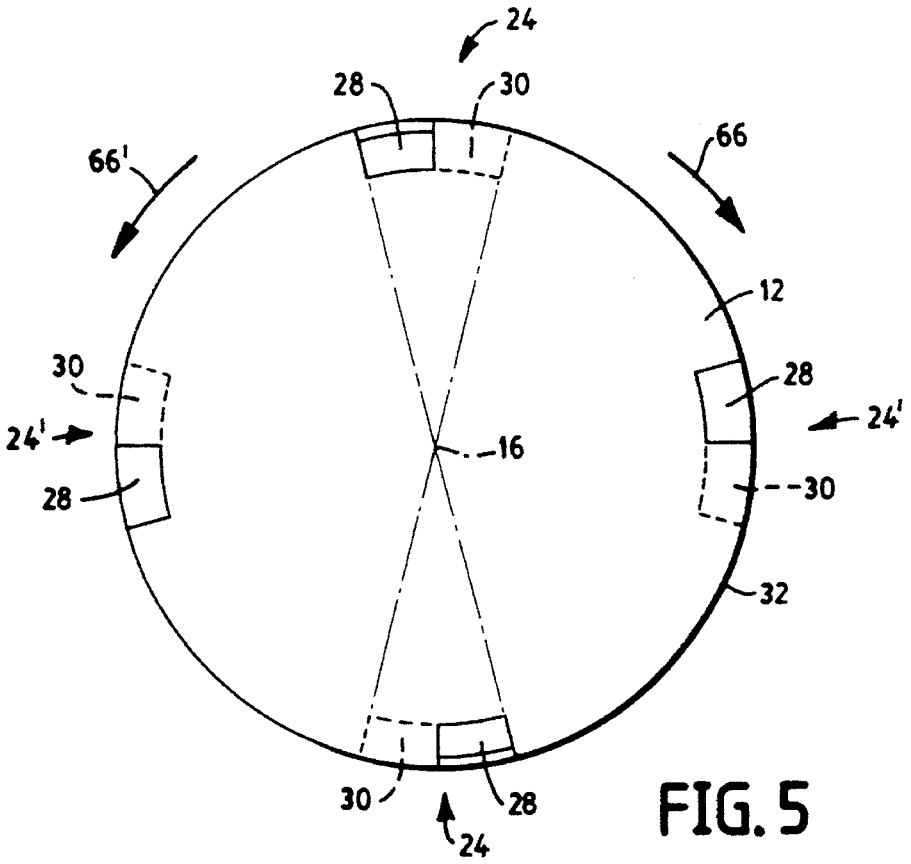
FIG. 5 is an end view of a first connector body of the present invention at the end where it interfaces with the second connector body.
Figure 6:
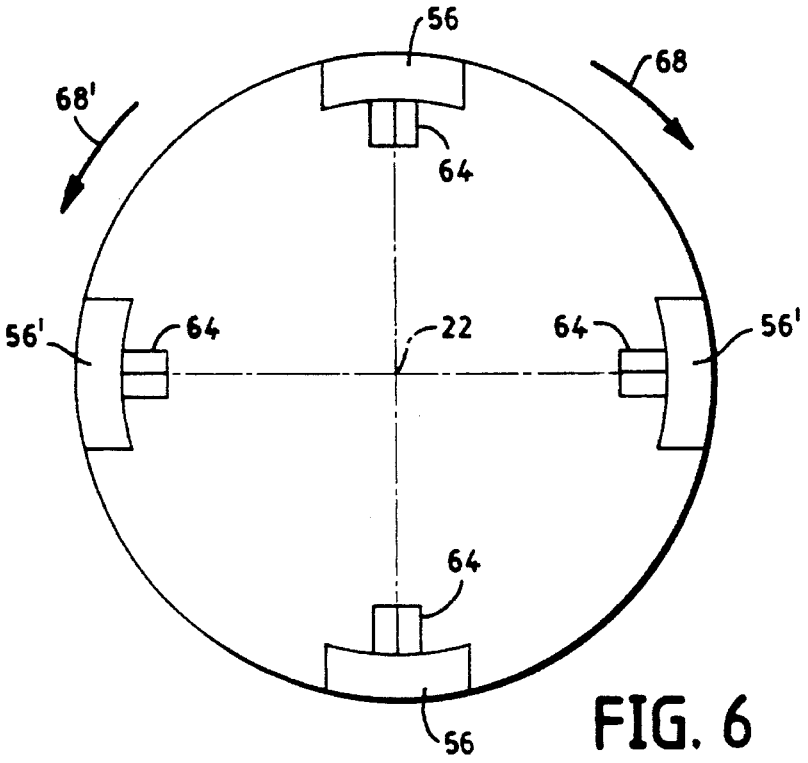
FIG. 6 is an end view of a second connector body of the present invention at the end where it interfaces with the first connector body.

As depicted in FIGS. 1 and 5, the two connectors 24 form a pair of connectors which are spaced from each other about 180° in a circumferential direction 66, 66' relative to axis 16. Similarly, as depicted in FIG. 6, the two connectors 56 are spaced from each other about 180° in a circumferential direction 68, 68' relative to axis 22 so that they may be aligned with respective connectors 24, as describe herein. An additional pair of identical connectors 24, designated 24' in FIG. 5, and an additional pair of identical connectors 56, designated 56' in FIG. 6, may be provided, if desired. Regardless of how many pairs of connectors 24, 24' and 56, 56' are provided, the spacing in the circumferential directions 66, 66' for the pairs of connectors 24, 24', and in the circumferential direction 68, 68' for the pairs of connectors 56, 56', will be such that the pairs of connectors 24, 24' will be in alignment with respective pairs of connectors 56, 56' during use, as described herein. As depicted in FIG. 5, ramps 28 are spaced from each other about 180° in direction 66, 66'. In this manner, the sequence of the ramps in the circumferential direction 66, 66' is ramp 28, ramp 30, ramp 28, ramp 30. In the preferred embodiment, a similar sequence will be used no matter how may pairs of connectors 24 are provided. The purpose of this sequence will be apparent hereinafter.

The present invention will now be described regarding the embodiment of FIGS. 1 to 4 which depict a positive latch connector which comprises two connectors 24 and two corresponding connectors 56. It will be apparent to those skilled in the art that the following description is also applicable to embodiments having more or less than two such connectors. In use, the connector body 18 is first oriented relative to the connector body 12 such that axes 16 and 22 are coincident and pins 64 are in axial alignment with respective ramps 28. Connectors 12 and 18 may then be moved relative to each other in directions 14', 20 causing pins 64 to engage respective ramps 28 in a connecting mode. By dimensioning the connectors such that the distance 70 between the tips of the pins 64 is about equal to or only slightly greater than the distance 72 between edges 44, such movement will cause ramps 28 to serve as cam surfaces for pins 64 to urge flexible segments 58 away from each other until the pins reach edges 48. As the pins move beyond edges 48 the resilience of the flexible segments 58 will cause pins 64 to snap into grooves 26 to lock the connectors 12 and 18 in place relative to each other in a connected mode. The connector 12 will be held in place axially relative to connector 18 by virtue of the fact that pins 64 will abut the bottom 74 of the ramps 28 whenever connectors 12 and 18 are moved relative to each other in axial directions 14, 20', respectively. In order to disconnect the positive latch connector 10, the connectors 12 and 18 may be rotated relative to each other in the directions 66', 68 respectively, identified in FIGS. 5 and 6. Such rotation will cause each pin 64 to move from a position at base surface 38, shown in solid lines in FIG. 4, to a position at base surface 40, shown in phantom lines so that pins 64 are no longer in alignment with respective bottoms 74. Such movement will be facilitated by the presence of an inclined surface 42 upon which each pin 64 will slide in moving from a base surface 38 to a base surface 40. Inclined surfaces 42 also serve to prevent inadvertent rotational movement of connector 12 relative to connector 18. The connectors 12 and 18 may then be moved relative to each other in directions 14, 20', respectively, causing pins 64 to engage respective ramps 30 in a disconnecting mode. Such movement will cause the ramps 30 to serve as cam surfaces for pins 64 to urge flexible segments 58 away from each other until the pins reach edges 52. As the pins move beyond edges 52 the resilience of the flexible segments 58 will cause pins 64 to spring back towards each other and assume the configuration depicted in FIG. 1 as the connectors 12 and 18 are completely disconnected.

In considering the use of the positive latch connector 10 in one practical application, the connector bodies 12 and 18 may be in the form of cylindrical sleeves as depicted in FIG. 1. Such sleeves include bores 76 and 78 which extend completely through connector bodies 12 and 18, respectively. An electrical male antenna connector 80 may be positioned in bore 78, and a mating electrical female antenna connector 82 may be positioned in bore 76, in a conventional manner. When the connector bodies 12 and 18 are connected as described above, male connector 80 will extend into the female connector 82 in the usual manner to provide the desired electrical connection between the two. When in the connected mode, the connector bodies 12 and 18 will be mechanically locked to each other as a result of the abutment of each pin 64 with a bottom 74 of a ramp 28 as described herein. In this manner, the electrical connection between electrical connectors 80 and 82 will not be unintentionally disconnected; that is, electrical connection will be assured until the connector bodies 12 and 18 are rotated relative to each other to disconnect the positive latch connector 10 as described above.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A positive latch connector, comprising:

a first connector body extending in the direction of a first longitudinal axis and comprising at least one first connector which comprises:

a latch groove extending into an outer surface of said first connector body, said latch groove being spaced from an end of said first connector body in the direction of said first longitudinal axis;

a first ramp inclined away from said first longitudinal axis from said end to said latch groove; and a second ramp adjacent to said first ramp and inclined away from said first longitudinal axis from said latch groove to said end; and a second connector body extending in the direction of a second longitudinal axis and comprising at least one second connector which comprises a beam which comprises a pin which engages said first ramp in a connecting mode, engages said first latch groove in a connected mode and engages said second ramp in a disconnecting mode.

2. The positive latch connector of claim 1 wherein said at least one first connector includes one first connector and another first connector spaced from said one first connector about 180° in a circumferential direction relative to said first longitudinal axis, and further wherein said at least one second connector includes one second connector and another second connector spaced from said one second connector about 180° in a circumferential direction relative to said first longitudinal axis.

3. The positive latch connector of claim 1 wherein said latch groove comprises a first base surface adjacent said first ramp and a second base surface adjacent said second ramp.

4. The positive latch connector of claim 1 wherein said latch groove comprises a first base surface adjacent said first ramp and a second base surface adjacent said second ramp, said first base surface being connected to said second base surface by a third base surface which is inclined away from said first longitudinal axis from said first base surface to said second base surface.

5. The positive latch connector of claim 1 wherein said beam comprises a flexible segment which extends in the direction of said second longitudinal axis from a proximate end to a distal end, said pin protruding from said distal end towards said second longitudinal axis.

6. The positive latch connector of claim 2 wherein said beam comprises a flexible segment which extends in the direction of said second longitudinal axis from a proximate end to a distal end, said pin protruding from said distal end towards said second longitudinal axis.

7. The positive latch connector of claim 2 wherein said first ramp of said one first connector is spaced from said first ramp of said another first connector about 180° in a circumferential direction relative to said first longitudinal axis, and said second ramp of said one first connector is spaced from said second ramp of said another first connector about 180° in a circumferential direction relative to said first longitudinal axis.

8. A positive latch connector, comprising:

a first connector body extending in the direction of a first longitudinal axis and comprising at least one first connector which comprises:

a latch groove extending into an outer surface of said first connector body, said latch groove being spaced from an end of said first connector body in the direction of said first longitudinal axis, said latch groove comprising a base segment which is disposed below an outer peripheral surface of said first connector body;

a first ramp which extends, and is inclined away from, said first longitudinal axis from said end to said latch groove, said first ramp having a first edge adjacent said end, said first edge being disposed below said outer peripheral surface a first distance, said first ramp having an opposite second edge adjacent said latch groove, said second edge being disposed below said outer peripheral surface a second distance which is less than said first distance; and a second ramp which extends, and is inclined away from, said longitudinal axis from said latch groove to said end, said second ramp having one edge adjacent said end and another opposite edge adjacent said ramp; and a second connector body extending in the direction of a second longitudinal axis and comprising at least one second connector which comprises a beam which comprises a pin which engages said first ramp in a connecting mode, engages said first latch groove in a connected mode and engages said second ramp in a disconnecting mode.

9. The positive latch connector of claim 8 wherein said one edge of said second ramp is coincident with said outer surface of said first connector body, and said another opposite edge is coincident with said base segment of said latch groove.

10. The positive latch connector of claim 9 wherein said first connector body is cylindrical, and further wherein said second connector body is cylindrical.

11. The positive latch connector of claim 9 wherein said base segment comprises a first base surface adjacent said first ramp and a second base surface adjacent said second ramp.

12. The positive latch connector of claim 11 wherein said first base surface is connected to said second base surface by a third base surface which is inclined away from said first longitudinal axis from said first base surface to said second base surface.

13. The positive latch connector of claim 8 wherein said beam comprises a flexible segment which extends in the direction of said second longitudinal axis from a proximate end to a distal end, said pin protruding from said distal end towards said second longitudinal axis.

14. The positive latch connector of claim 8 wherein said first connector body comprises one or more pairs of first connectors, each pair of said one or more pairs including one first connector and another first connector spaced from said one first connector about 180° in a circumferential direction relative to said first longitudinal axis, and further wherein said second connector body comprises one or more pairs of second connectors, each pair of said one or more pairs including one second connector and another second connector spaced from said one second connector about 180° in a circumferential direction relative to said second longitudinal axis, each first connector being in alignment with a respective second connector in said connecting mode, connected mode and disconnecting mode.

15. The positive latch connector of claim 14 wherein said first ramp of said one first connector is spaced from said first ramp of said another first connector about 180° in a circumferential direction relative to said first longitudinal axis, and said second ramp of said one first connector is spaced from said second ramp of said another first connector about 180° in a circumferential direction relative to said first longitudinal axis.

16. The positive latch connector of claim 1 wherein said first connector body comprises one or more pairs of first connectors, each pair of said one or more pairs including one first connector and another first connector spaced from said one first connector about 180° in a circumferential direction relative to said first longitudinal axis, and further wherein said second connector body comprises one or more pairs of second connectors, each pair of said one or more pairs including one second connector and another second connector spaced from said one second connector about 180° in a circumferential direction relative to said second longitudinal axis, each first connector being in alignment with a respective second connector in said connecting mode, connected mode and disconnecting mode.

17. The positive latch connector of claim 16 wherein said first ramp of said one first connector is spaced from said first ramp of said another first connector about 180° in a circumferential direction relative to said first longitudinal axis, and said second ramp of said one first connector is spaced from said second ramp of said another first connector about 180° in a circumferential direction relative to said first longitudinal axis.

18. The positive latch connector of claim 1 wherein said first connector body is cylindrical and further wherein said second connector body is cylindrical.

19. The positive latch connector of claim 18 wherein said latch groove comprises a first base surface adjacent said first ramp and a second base surface adjacent said second ramp, said first base surface being connected to said second base surface by a third base surface which is inclined away from said first longitudinal axis from said first base surface to said second box surface.

20. The positive latch connector of claim 13 wherein a first ramp of each one first connector is spaced from a first ramp of another first connector about 180° in a circumferential direction relative to said first longitudinal axis, and said second ramp of said one first connector is spaced from a second ramp of another first connector about 180° in a circumferential direction relative to said first longitudinal axis.

* * * * *